United States Patent [19]

Bandel

[11] Patent Number: 4,624,633

[45] Date of Patent: Nov. 25, 1986

[54] HIGH PERCENTAGE GLYCOL FUEL AND BURNER

[75] Inventor: David Bandel, Westminster, Calif.

[73] Assignee: MTC-Choice, Inc., Harbor City, Calif.

[21] Appl. No.: 811,141

[22] Filed: Dec. 19, 1985

Related U.S. Application Data

[60] Division of Ser. No. 690,026, Jan. 9, 1985, abandoned, and a continuation-in-part of Ser. No. 621,217, Jun. 16, 1984, abandoned.

[51] Int. Cl.[4] ..... F23D 3/24

[52] U.S. Cl. ..... 431/320; 431/344; 126/265; 44/77

[58] Field of Search ..... 431/320, 344; 44/56, 44/77; 126/265

[56] References Cited

U.S. PATENT DOCUMENTS

| | | | |
|---|---|---|---|
| 2,089,580 | 8/1937 | Schulze | 44/77 |
| 3,061,420 | 10/1962 | McTurk et al. | 44/77 |
| 3,103,101 | 9/1963 | Jaffer | 44/77 |
| 3,230,058 | 1/1966 | Walters | 44/77 |
| 3,240,009 | 3/1966 | Walters | 44/77 |
| 3,291,580 | 12/1966 | Mauck | 44/77 |
| 4,035,138 | 7/1977 | Walters | 431/320 |
| 4,126,408 | 11/1978 | Cox | 431/320 X |
| 4,416,668 | 11/1983 | Thompson | 44/76 X |

*Primary Examiner*—Randall L. Green

*Attorney, Agent, or Firm*—Henderson & Sturm

[57] ABSTRACT

The combination of a novel fuel (18) with a fuel canister (14) and a wick (16) for transporting the novel fuel (18) from the interior to the exterior of the canister (14); wherein the novel fuel comprises a combustible fuel having a flash point greater than 100° F. and comprising a minimum of 20% of a glycol or a glycol derivative.

13 Claims, 5 Drawing Figures

FIG. 1.
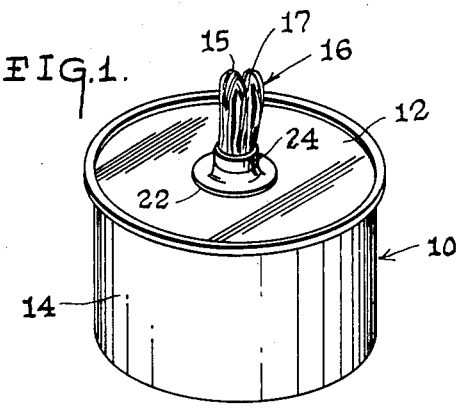
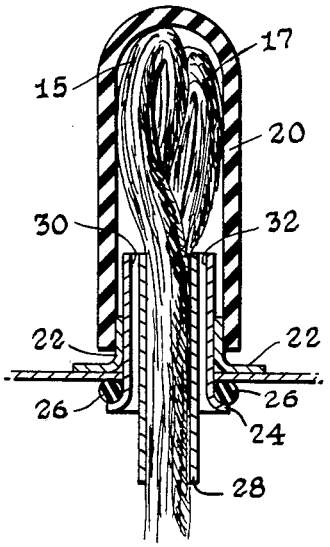
FIG. 3.
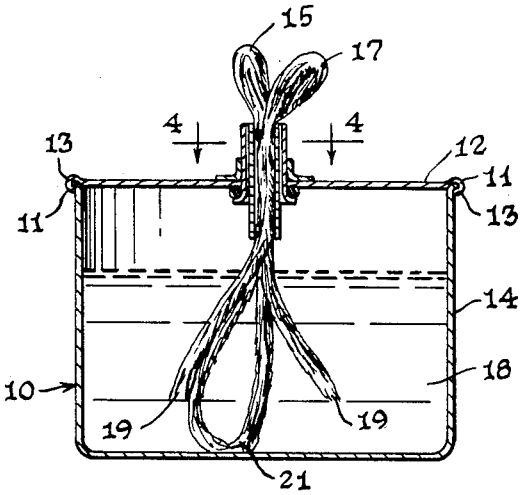
FIG. 2.
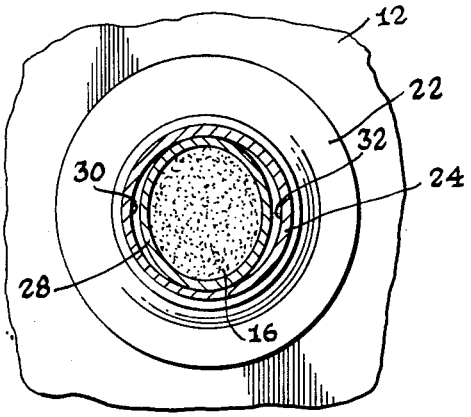
FIG. 4.
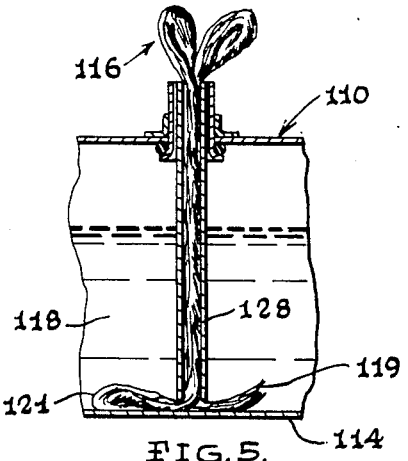
FIG. 5.

HIGH PERCENTAGE GLYCOL FUEL AND BURNER

This is a continuation-in-part application of U.S. patent application Ser. No. 621,217 filed June 16, 1984, and entitled GLYCOL FUEL BURNER, and a divisional application of U.S. patent application Ser. No. 690,026 filed Jan. 9, 1985, and entitled HIGH PERCENTAGE GLYCOL FUEL AND BURNER, both being abandoned.

BACKGROUND OF THE INVENTION

1. Field of the Invention

This invention relates generally to a self-contained device for generating heat through combustion of a non-pressured, high flash point fuel (>100° F.) utilized primarily for heating food and the like. More particularly, this invention pertains to a closed cartridge containing a reservoir of a novel high percentage glycol or glycol derivative fuel and a non-consumable wick immersed in the fuel reservoir to provide controllable means for combusting said glycol or glycol derivative. These devices are commonly found in applications utilizing chafing dishes where food is to be maintained at an elevated termperature for extended periods of time.

2. Description of the Prior Art

Restaurants and others involved in the food preparation industry typically have a requirement for maintaining various foodstuffs at an elevated temperature for extended periods of time to maintain said food's edibility as well as to preserve the food from infection by exogenous microorganisms.

Prior art means for maintaining foods at elevated temperatures include cartridges and canisters containing alcohol fuels such as methyl and ethyl alcohol;. Said alcohol fuels have relativley low flash points, typically in the range 54° F. to 56° F., which permit these fuels to be ignited directly by flame provided by a match or a candle. These types of prior art devices have several inherent drawbacks which create substantial problems for their users.

Most significant among the disadvantages to prior art devices are those encountered in the field of product safety. Utilization of methyl and ethyl alcohols creates a substantial hazard due to fire. This fact arises from the high volatility and low falsh point of these one and two carbon alcohols.

A second significant safety concern is that of noxious vapors. Those prior art devices utilizing methyl alcohol as their fuel present a substantial hazard with respect to methanol vapors. Said vapors are toxic and additionally can contaminate any food stored or located in the vicinity of these devices.

The third safety consideration is that of shipping. Prior art devices containing methanol and ethanol as their fuels have various restrictions placed upon them by those authorities regulating common carriers and other shippers. Thus, prior art devices are more expensive and inconvenient to transport due to the inherent hazards presented by their fuels.

Additionally, prior art devices present a disadvantage in that the range of heat developed by such devices is not easily adjustable. Most prior art devices is not easily adjustable. Most prior art devices utilize various mechanical means to adjust the oxygen flow available for combustion of the methanol and ethanol. This arrangement for control of heat is inadequate in many cases where a very low flame is required because the amount of oxygen required for low flame cannot be adequately regulated using prior art mechanical means thus causing the flame to be often spontaneously extinguished.

Therefore, it is desireable to provide a burner device for controllably heating and warming food and the like utilizing a new and unique, clean burning, high percentage glycol or glycol derivative fuel having a low vapor pressure and high flash point relative to commonly used fuels such as methanol and ethanol. Moreover, it is desirable that such a burner utilize a fuel which is nontoxic and produces a low level of nontoxic vapors. It is also desirable that such an improved heating device should have a continually adjustable flame by controlling the amount of fuel available for combustion.

While the prior art recognizes that glycol or glycol derivatives can be used as fuel additives; these additives are in minimal amounts (i.e. concentrations measured in parts per million) and are included to enhance the characteristics of the primary fuel component. In addition, glycol or glycol derivatives in substantial concentrations have never before been used, or suggested for use, as the primary fuel component.

Finally, it is desirable to provide a burner that is safe to ship and use and has minimal regulatory restrictions on shipment and storage relative to prior art devices.

SUMMARY OF THE INVENTION

Therefore, it is provided in the practice of this invention according to a presently preferred embodiment a fuel burner comprising a closed canister having an opening disposed in one end thereof and a reservoir of a high percentage glycol or glycol derivative fuel contained therein. Said burner additionally comprises a non-consumable wick having one end immersed in said fuel reservoir and the opposite end extending through the opening in the canister, means for equalizing the pressure within the canister to that of the surrounding atmosphere and means for adjusting the heat generated by the device by regulating the amount of fuel available for combustion.

BRIEF DESCRIPTION OF THE DRAWINGS

These and other features and advantages of the present invention will be better understood by reference to the following description when considered in connection with the accompanying drawings where:

FIG. 1 is a perspective view of a fuel burner constructed according to the principles of this invention;

FIG. 2 is a cross-sectional view through the central axis of the fuel burner;

FIG. 3 is an enlarged detailed cross-section of the burner showing the assembly for affixing the wick;

FIG. 4 is an enlarged cross-sectional view taken along line 4—4 of FIG. 2; and FIG. 5 is a fractional cross-sectional view showing the details of an alternative embodiment of the fuel burner constructed according to the principles of this invention.

DESCRIPTION OF THE PREFERRED EMBODIMENTS

FIGS. 1, 2, 3, and 4 illustrate a preferred embodiment (10) of a glycol or glycol derivative fuel burner constructed according to the principles of this invention. As used herein the term "gylcol" means any dihydroxy or trihydroxy alcohol (i.e., a compound containing two or three alcoholic hydroxyl groups). For example, ethylene glycol, diethylene glycol, triethylene glycol, tetraethylene glycol, butylene glycol, hexylene glycol or glycerol.

The term "glycol derivative" as used herein is defined as a compound selected from the group consisting of:

1. Ethylene glycol ethers having the general formula $HO—CH_2—CH_2—O—R$;
2. Diethylene glycol ethers having the general formula $HO—CH_2—CH_2—O—CH_2—CH_2—O—R$;
3. Ethylene glycol derivatives having the general formula $R—O—CH_2—CH_2—O—R$; and
4. Diethylene glycol derivatives having the general formula $R—O—CH_2—CH_2—O—CH_2—CH_2—O—R$, where R is an alkyl radical having one to four carbon atoms.

In the preferred embodiment, the fuel is selected from the group consisting of ethylene glycol, diethylene glycol and methyl ethers where R has one carbon atom; or a dihydric or polyhydric compound, or a derivative such as polyethylene or polypropylene oxides in which the carbon to oxygen ratio is 4:1 or less.

A canister (14) open at one end is preferably cylindrical in shape and comprised of a one piece stamping of a light gauge ferrous or nonferrous metal. Disposed within the open end of the canister (14) is a ferrous or nonferrous circular top (12) which is preferably affixed to the canister (14) by crimping the periphery (13) of the top (12) about the exposed edge (11) of the canister (14).

Alternatively, the top may be of the "screw" type where the top defines threads which cooperatively engage threads disposed in the canister. This arrangement permits the apparatus to be conveniently refilled.

Disposed in the approximate center of the circular top (12) of the canister (14) is a circular opening through which a cylindrical eyelet (24) passes. The end of the eyelet (24) extending into the interior of the canister (14) is flared and provides a seating means for an elastomeric O-ring (26). Press fit over the outside diameter of the end of the cylindrical eyelet (24) extending through the circular opening disposed within the top (12) of the canister (14) is a clamp ring (22) for permanently affixing the eyelet (24) and its associated O-ring (26) to the top of the canister (12). The O-ring (26) provides sealing means for preventing the glycol or glycol derivative fuel (18) from migrating, by capillary action, between the edge of the hole disposed in the top (12) and the outer circumference of the eyelet (24). Said eyelet (24) and associated clamp ring (22) are preferably constructed from brass, but may be alternatively constructed from any other ferrous or other nonferrous metallic substance.

A wick tube (28) has an oval cross section selected to have an outside diameter along its major axis such that it is inserted within and frictionally coupled to the inner surface of the eyelet (24). The wick tube (28) is preferably constructed from aluminum, but may alternatively be constructed from any ferrous or other nonferrous metal.

Passing through the lumen of the wick tube (28) is a non-consumable wick (16) which is preferably fabricated from Johns-Manville JM2000 TM fiberglass yarn. Manufacturers of fiberglasss yarns typically impart a proprietary coating on their products which results in wide ranging variability in the ability of the various yarns to transport glycol and glycol derivatives by capillary action. The Johns-Manville product specified herein has proved to be ideal for this application.

The wick (16) is comprised of a continuous length of glass fibers to form the number of loops that will provide sufficient glass fiber to transport the fuel to the combustion zone to maintain the desired combustion rate. Preferably the wick forms first and second loops (15) and (17), respectively, at the end extending through the wick tube (28) to the exterior of the canister (14). Alternatively, the wick (16) may not be folded, but cut at each end forming single strand having an outside diameter large enough to frictionally couple the wick (16) to the lumen of the wick tube (28).

The ends (19) of the wick (16) and a single loop (21) are disposed within the canister (14) and immersed at least partially within a reservoir of substantially pure glycol and/or glycol derivative fuel (18).

As mentioned earlier in the specification, the fuel (18) comprises a high percentage glycol fuel. Ideally this novel fuel would be pure (i.e. 100%) glycol or a glycol derivative, as defined by the terms set forth above.

While obviously less desirable, the fuel (18) for the purposes of this invention may also contain other ingredients; however, it is to be understood that glycol or a glycol derivative must comprise a substantial portion of the fuel, and in no instance should the fuel contain less than 20% glycol or a glycol derivative.

Preferably, said fuel (18) is diethylene glycol. Altnerative, other dihydroxy alcohols may be utilized such as ethylene glycol. Moreover, said glycol fuel (18) can be comprised of other aliphatic and aromatic dihydroxy alcohols and glycol derivatives as set forth above.

First and second breathers (30) and (32), respectively, are defined by a portion of the exterior surface of the wick tube (28) and the interior surface of the eyelet (24). Said breathers (30) and (32) are crescent shaped in cross section and have a maximal cross-sectional width, substantially less than that of the inside diameter of the lumen with the eyelet (28). Said first and second breathers (30) and (32) permit communication between the interior of the burner (10) and the surrounding atmosphere and thus allow equalization of the pressure within the burner (10) to that of the surrounding atmosphere.

A protective elastomeric cap (20) is supplied for shipping and storage of the burner (10). The interior surface of said cap (20) is frictionally coupled to the outside diameter of the clamp ring (22) to provide a seal therebetween to prevent any loss of the fuel (18).

Because glycol and glycol derivatives have high flash points (>100° F.) and low vapor pressures, they cannot be ignited by directly contacting them with a match flame. However, immersion of the wick (16) into the high percentage glycol or glycol derivative fuels create capillary flow within said wick (16) of the fuel (18) so that it is transported to the end of the wick (16) extending outside of the burner (10). Said wick (16) is comprised of a multiplicity of glass fibers which provide a substantial surface area to facilitate combustion of the fuel (18).

The quantity of heat generated by the burner (10) can be controlled by one of two means. The wick (16) can be extended from the burner (10) by pulling the wick (16) through the wick tube (28) thus increasing the available combustion surface area of the wick (16) and consequently increasing the heat by increasing the amount of fuel combusted per unit of time. Accordingly the consumption of the fuel (18) can be relatively reduced and the heat generated thereby concomitantly reduced by pushing the wick (16) into the canister (14) through the wick tube (28).

Alternatively, where the wick defines at least two loops at the end extending outside the canister, heat generation can be controlled by "butterflying" the wick as shown in FIG. 2. Separating the first and second loops (15) and (17) of the wick (16) creates a greater surface area of fuel exposed to atmospheric oxygen, and thus a consequently greater consumption of fuel and generation of heat from that configuration shown in FIG. 1 where the first and second loops (15) and (17) are maintained in close proximity to each other thus limiting the availability of oxygen for combustion.

As fuel (18) is consumed by the burner (10), a positive pressure would be developed within the canister if atmosphere pressure were not permitted to equalize to the pressure gradient developed within the canister. The first and second breathers (30) and (32) provide continuous equalization of atmosphereic pressure with that of the interior of the burner (10) thus assuring that a constant and uninterrupted flow of fuel will be available for combustion.

FIG. 5 shows an alternative embodiment (110) wherein the wick tube (128) extends into the fuel (118) reservoir contained within the canister (114) to a point in close proximity to the bottom of said canister (114).

This arrangement provides means for frictionally coupling the ends (119) of the wick (116) as well as the loop (121) disposed within the canister between the end of the tube (128) and the bottom surface of the canister (114). This embodiment ensures that the wick (116) cannot be disturbed or pulled from the wick tube (128) inadvertently.

The described embodiments of the invention are only considered to be preferred and illustrative of the inventive concept. The scope of the invention is not restricted to such embodiments. Various and numerous other arrangements may be devised by one skilled in the art without departing from the spirit or scope of this invention.

I claim:

1. The combination of a novel fuel with a fuel canister and a wick for transporting the said novel fuel from the interior to the exterior of the canister wherein the novel fuel comprises:

a combustible fuel having a flash point greater than 100° F. and comprising a minimum of 20% of a glycol.

2. The combination of a novel fuel with a fuel canister and a wick for transporting the said novel fuel from the interior to the exterior of the canister wherein the novel fuel comprises:

a combustible fuel having a flash point greater than 100° F. and comprising a minimum of 20% of a glycol derivative.

3. The combination of claim 1 wherein the novel fuel is selected from the group consisting of ethylene glycol, diethylene glycol, triethylene glycol, tetraethylene glycol, butylene glycol, hexylene glycol and glycerol.

4. The combination of claim 1, wherein the combustible fuel comprises a maximum of 100% glycol.

5. The combination of claim 2, wherein the combustible fuel comprises a maximum of 100% of a glycol derivative.

6. The combination of claim 2, wherein the glycol derivative fuel is an ethylene glycol ether having the general formula $HO—CH_2—CH_2—O—R$ in which R is an alkyl radical having one to four carbon atoms.

7. The combination of claim 2, wherein the glycol derivative fuel is a diethylene glycol ether having the general formula $HO—CH_2—CH_2—O—CH_2—CH_2—O—R$ in which R is an alkyl radical having one to four carbon atoms.

8. The combination of claim 2, wherein the glycol derivative fuel is an ethylene glycol derivative having the general formula $R—O—CH_2—CH_2—O—R$ in which R is an alkyl radical having one to four carbon atoms.

9. The combination of claim 2, wherein the glycol derivative fuel is a diethylene glycol derivative having the general formula $R—O—CH_2—CH_2—O—CH_2—CH_2—O—R$ in which R is an alkyl radical having one to four carbon atoms.

10. The combination of a novel fuel with a fuel canister and a wick for transporting the said novel fuel from the interior to the exterior of the canister wherein the novel fuel comprises:

a combustible fuel having a minimum of 20% of a dihydroxy compound from among the group comprising propylene glycol and dipropylene glycol.

11. The combination of a novel fuel with a fuel canister and a wick for transporting the said novel fuel from the interior to the exterior of the canister wherein the novel fuel comprises:

a combustible fuel having a minimum of 20% of a polyhydroxy compound consisting of glycerol.

12. The combination of a novel fuel with a fuel canister and a wick for transporting the said novel fuel from the interior to the exterior of the canister wherein the novel fuel comprises:

a combustible fuel having a minimum of 20% of a compound consisting of a propylene glycol ether from among the group comprising propylene glycol methyl ether, dipropylene glycol methyl ether and tripropylene glycol methyl ether.

13. The combination of a novel fuel with a fuel canister and a wick for transporting the said novel fuel from the interior to the exterior to the canister wherein the novel fuel comprises:

a combustible fuel having a minimum of 20% of a compound from among the group consisting of ethylene glycol, diethylene glycol, triethylene glycol, tetraethylene glycol, butylene glycol, hexalene glycol and glycerol.

* * * * *